United States Patent [19]

Jönsson

[11] 4,292,914

[45] Oct. 6, 1981

[54] METHOD AND APPARATUS FOR FACILITATING UNDERWATER WORK ON SHIP HULLS AND LIKE OBJECTS

[76] Inventor: Carldavid Jönsson, S-585, 90 Linköping, Sweden

[21] Appl. No.: 37,272

[22] Filed: May 9, 1979

[30] Foreign Application Priority Data

May 9, 1978 [SE] Sweden ..... 7805277

[51] Int. Cl.[3] ..... B63B 59/00

[52] U.S. Cl. ..... 114/222; 405/12; 405/193

[58] Field of Search ..... 114/222, 240 D, 45, 114/77 R, 77 A, 67 A, 264; 166/356; 405/193, 12

[56] References Cited

U.S. PATENT DOCUMENTS 3,611,610 10/1971 Yamamoto ..... 114/77 R
3,991,583 11/1976 Scurlock ..... 405/193

FOREIGN PATENT DOCUMENTS 1221773 2/1971 United Kingdom .
1225338 3/1971 United Kingdom .
1255214 12/1971 United Kingdom .
1501657 2/1978 United Kingdom .

*Primary Examiner*—Douglas C. Butler

[57] ABSTRACT

This invention relates to an apparatus for facilitating working on especially horizontal underwater portions of ship hulls, pontoons and other floating objects. The novel feature resides in that the apparatus comprises a screen structure adapted to be tightly fitted along the edges of the surface on which operations are to be carried out, and projecting downwardly from the surface, the screen structure being sealed against the surface and laterally, but perforated or open downwardly, and a pipe for introducing air with a pressure adapted to the water pressure prevailing at the actual depth, into the space within the screen structure in order to provide an air volume serving as a work-space, under the surface.

8 Claims, 9 Drawing Figures

METHOD AND APPARATUS FOR FACILITATING UNDERWATER WORK ON SHIP HULLS AND LIKE OBJECTS

The present invention relates to a method of facilitating working on especially horizontal underwater portions of ship hulls, pontoons and other floating objects.

When being covered with growth or affected with corrosion and the like, the underwater portions of ship hulls, pontoons and other, mobile or stationary, floating objects must be treated by blasting and, where appropriate, by welding, painting and like operations.

It is previously known to carry out cleaning, welding and painting operations under the water surface with the aid of divers, but it has been found that the quality of the work carried out will not be as high as desired. Moreover, especially when it is a question of applying compositions of paint containing a high percentage of poison to prevent growth, the prior art entails great inconveniences and risks as this results in heavy spillage of paint and, consequently, strong pollution of the water, In connection with repairing and, especially, welding operations on underwater portions of ship hulls, one has previously used caissons which were submerged and placed against the portion to be treated, whereupon the caisson, which as a rule was provided with a descending pipe sticking up out of the water, was pumped dry and thus fit for use as a dry workspace. However, prior art caissons only lend themselves to operations concerning minor portions of a ship hull.

The object of this invention is to provide an apparatus making it possible, without raising the hull or like object, to withdraw the water from the downwardly facing side of the hull in order to form under said surface a space in which the required operations may be carried out. The essential characteristic of the method according to the invention is that it comprises the steps of fitting, along the edges of the surface on which operations are to be carried out, a screen structure which is sealed against said surface and laterally, but is downwardly perforated or open, and introducing air with a pressure adapted to the water pressure prevailing at the actual depth, into the space within said screen structure in order to provide an air volume serving as a workspace, which is defined upwardly by the hull surface, laterally by the screen structure, and downwardly by the displaced water.

The method and various embodiments of the apparatus for carrying out the method according to the invention will be described in more detail hereinbelow with reference to the accompanying drawings, in which:

FIGS. 1 and 2 illustrate the basic principle of the invention.

Figure 1:
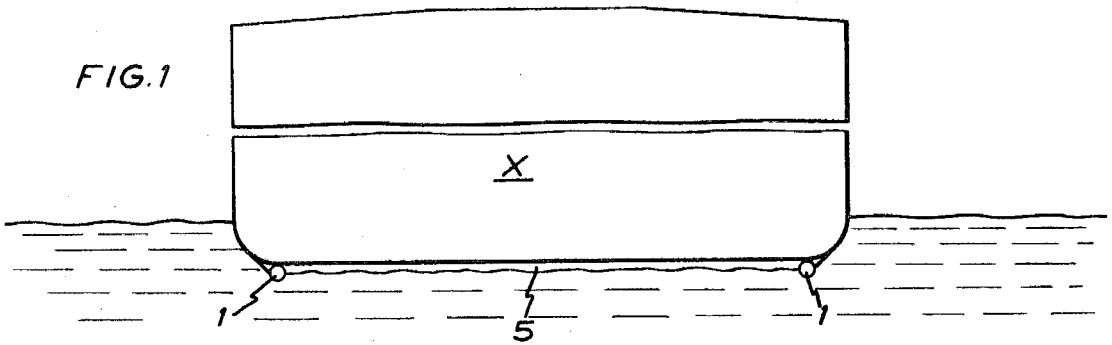
FIG. 1 is a schematic sectional view of a ship hull with the apparatus of the invention placed in position of use under the hull.

Placed under a ship hull, designated X in FIG. 1, is a screen structure 1 extending along the edges of the so-called flat-bottom and adapted to embrace the substantially planar portion of said bottom or the portion thereof on which operations are to be carried out.

As shown in FIGS. 3–9, the screen structure consists of tightly united sections 2 provided at the top with seals engaging the hull. The screen structure may of course also comprise separating sections dividing up the space inside the screen structure longitudinally and/or transversely.

The screen frame formed of the sections is held in position, as will be described below, on one hand, by buoyancy and, on the other hand, by means of wires or the like 4, attached to the hull. Wires or the like 4' serve as cross-ties between the side portions of the screen structure.

Figure 2:
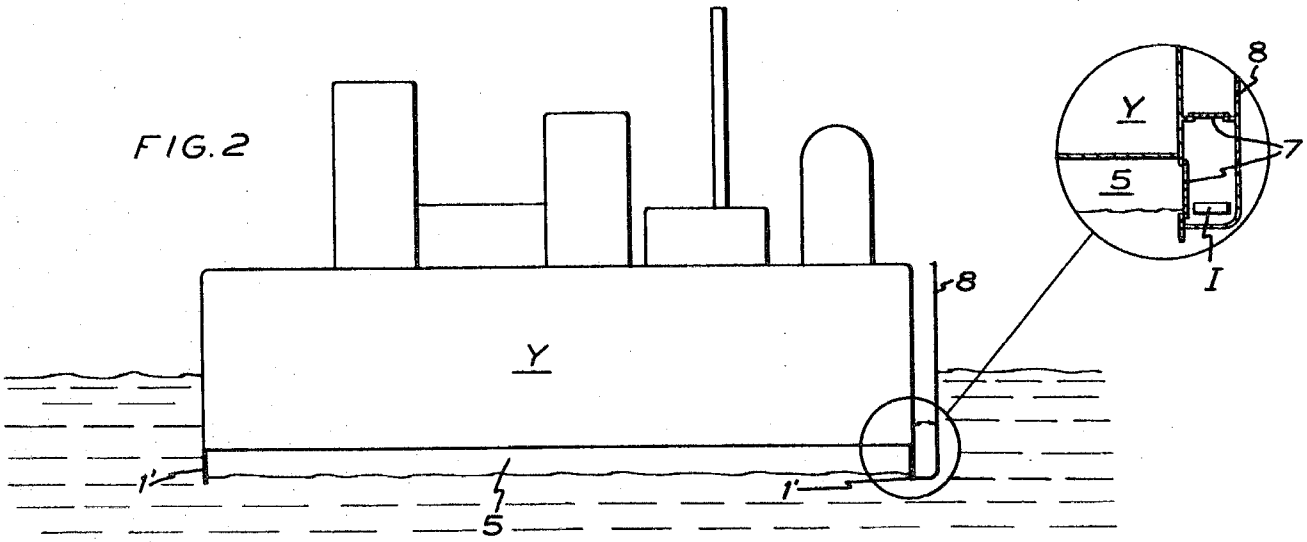
FIG. 2 is a schematic sectional view of a pontoon for a factory plant or the like, where the pontoon is permanently provided with an apparatus according to the invention.

In FIG. 2, Y designates a pontoon for a floating factory or the like, and when it is manufactured this pontoon is provided with a screen structure 1' extending downwardly along the edges of the pontoon.

Due to the fact that air with a pressure substantially equal to the prevailing water pressure is introduced inside the screen structure 1 or 1', water inside said structure can be displaced, whereby there is obtained inside the screen structure 1 or 1' an air-filled space 5 in which the required operations can be carried out with the aid of tools of essentially the same type as used in docked ships.

Figure 3:
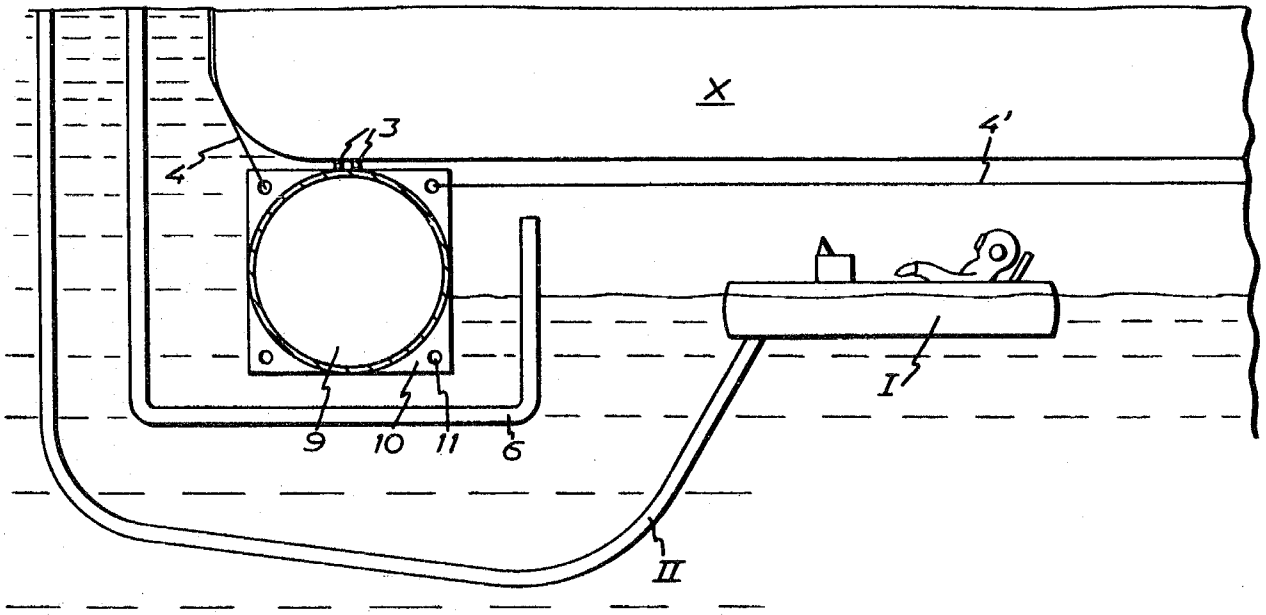
FIG. 3 shows on an enlarged scale and in section a portion of the hull of FIG. 1.
Figure 4:
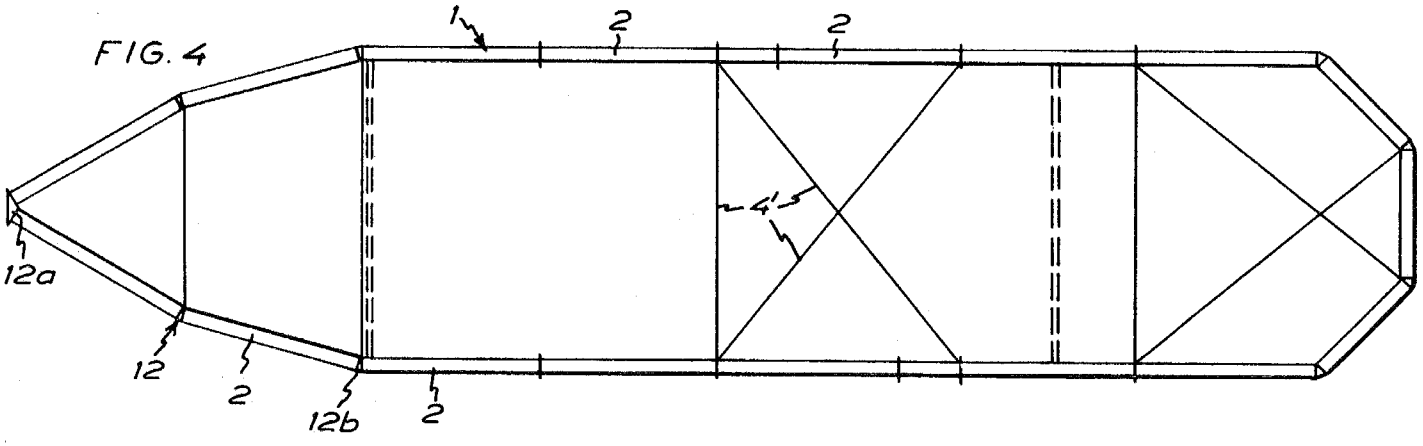
FIG. 4 is a top plan view of the screen structure applied to the hull of FIG. 1.
Figure 6:
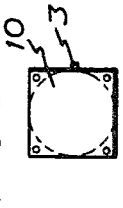
FIG. 6 is an end view of the section of FIG. 5.
Figure 5:
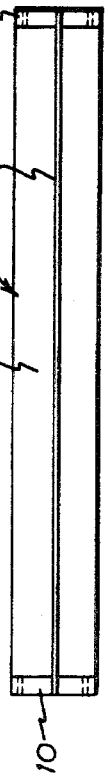
FIG. 5 is a top plan view showing on an enlarged scale one of the sections of the screen structure of FIG. 4.
Figure 9:
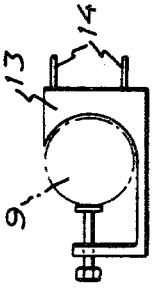
FIGS. 7, 8 and 9 show interconnecting units for angular connection of the sections of FIG. 5.

Also in FIG. 3 the screen structure formed of the sections 2 is designated by 1 and the seals by 3. As air is supplied through a pipe 6 into the space 5 inside the screen structure 1, the water level inside the structure will sink enough to provide an air-filled space along the entire bottom of the ship.

The required operations on the now dry hull bottom can be carried out in said space by means of a craft I manned with an operator in a frogman's suit and provided with suitable propelling means and tools such as blasting means and paint application means.

The craft is supplied with air, blasting material, electrical current and the like through a service line designated II. In addition to the propelling means permitting movement in all directions, the craft should be provided with means for controlling the draught so as to allow the craft to move underneath the screen structure 1 towards and away from the space inside said structure.

In the apparatus shown in FIG. 2, which is permanently secured to the pontoon, a descending shaft 8, provided with a pressure equalizing lock 7 such as commonly used in connection with submarine equipment, is arranged close to the pontoon. As shown in this figure, a housing for a craft I may be placed at the lower end of the shaft.

Also in this embodiment, the space may be divided up, by means of separating, stationary or mobile, intermediate walls, into several, separately used compartments, said intermediate walls or said compartments being provided with entrance means.

When it is required to inspect or treat the bottom of the pontoon one only has to introduce air into the space or said compartments inside the screen structure 1' through preferably stationary conduits and when the intended air volume is complete it is possible to move into said space through the pressure equalizing lock of the descending shaft by means of the craft I.

A preferred embodiment, illustrated in FIGS. 3–9, of the screen structure 1 for ship hulls consists, as already mentioned, of a number of sections 2 which are connected to each other with regard to the dimensions of the hull.

Each section 2 consists of a pipe 9 which is closed at its ends, said ends being provided with flanges 10 with bolt holes 11. A plurality of sections 2 can thus be united so as to constitute a substantially rigid unit.

Figure 8:
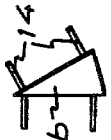
Figure 7:
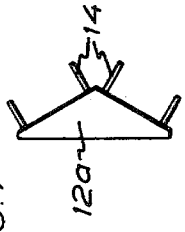

To permit angular interconnection of sections, use is made of interconnecting units 12*a*, 12*b* of the type shown in FIGS. 7 and 8 consisting of blocks of appropriate material such as steel. The blocks are coupled between screen sections 2, wherein the blocks engage the flanges 10 of the sections 2. Sections of various length may be used and it is also possible to join a section at a square angle with another section by using the angle joint 13 shown in FIG. 9.

The interconnecting units 12 as well as the angle joint 13 have screws 14 which fit into the holes 11 in the flanges of the sections. Nuts engaging the bolts secure the blocks to the sections and hold the adjoining sections together.

The seals 3 are situated on that side of the sections which is to face the ship bottom and consist of two or more strips of elastic material and may be completed with sealing material to be injected in the interstices between the strips.

When a ship hull is to be treated, a screen frame structure having the dimensions required with regard to the size of the hull is mounted up, as described above. The sections are airfilled during the mounting operation so that each of them can be moved separately and in a simple way to their respective mounting positions. After mounting, the sections are ballasted with water and allowed to submerge below the water level to a depth where the assembled screen frame structure can be towed underneath the hull or vice versa. The ballast water is then pressed out from the sections 2, which causes the entire structure to lift so that it will bear against the underside of the hull. After the wires 4 have been fitted between the screen structure and suitable attachments, for instance the upper edge of the hull, and have been tightened so that the frame structure will be kept pressed against the bottom, air is introduced into the space inside the structure through the pipe 6, FIG. 3. Under the influence of the air the water level in said space will sink maximally to the lower edge of the screen structure. The supplied air should be dry and have a temperature exceeding the water temperature. Drying of the outside of the hull is preferably effected by means of hot water which is supplied by the ship and introduced into the spaces on the inside of the hull and heats the bottom plates.

The craft I can be moved underneath the screen structure and the work can be started when the intended volume of air has been obtained.

When the work is completed and the time that may be required for the hardening of the paint has come to an end, then the air is evacuated from the space inside the screen structure, the wire connections 4 are released and the sections are ballasted so that the structure can be removed from the hull.

It should be noticed in this connection that the surface finishing operations on the remaining parts of the hull, i.e. the stays and the stem and stern sections, do not normally require any special measures since in the ships actually concerned in this connection it is possible to turn the hull by trimming the ballast tanks enough to make said parts accessible above the water level.

The present specification and drawings do not comprise such details as e.g. pipe and valve systems for ballasting and blowing of the sections 2, since these systems may be of various types.

Instead of, or as a supplement to the previously mentioned craft, use may be made of a travelling gantry system suitable carried by the screen structure and this system may of course also be used in the screen structure permanently secured to the pontoon of FIG. 2.

In the embodiments shown the screen structure 1 or 1' has no bottom but is entirely open in downward direction. However, according to a modified embodiment the screen structure may have a bottom in the form of a grate. In bottomed screen structures, where the bottom, like the rest of the screen structure, suitably consists of connectible sections, the operators may stand on the bottom during the operation. This embodiment is especially applicable to hulls of small dimensions, where the work can be carried out by means of manual tools.

The bottom of the screen structure may also be constructed in such a way that it will replace the otherwise necessary lateral stays 4', which extend across the space inside the screen structure.

The invention should not be considered limited to that described herein and shown in the drawings but may be modified in various ways within the scope of the appendant claims.

What I claim and desire to secure by Letters Patent is:

1. An apparatus for facilitating working on especially horizontal underwater portions of ship hulls, pontoons and other floating objects, comprising a screen structure having means for tightly fitting said screen structure against the edges of the surface on which operations are to be carried out, said screen structure projecting downwardly from said surface, said screen structure having a top edge which is sealed against said surface, said screen structure having a bottom which is open for a major portion of the area circumscribed by said screen structure so that said circumscribed area is filled with water, and means for introducing air into the volume associated with said circumscribed area and said screen structure with a pressure adapted to the water pressure prevailing at the actual depth into the volume within said screen structure in order to provide an air volume serving as a work-space under said surface, said pressurized air being essentially the sole means for preventing contact between said water and said surface within said circumscribed area.

2. Apparatus as claimed in claim 1, wherein the screen structure consists of a screen frame (1), built up by means of substantially rigid sections (2) and adapted to the form and size of said surface, said frame structure being provided with seals (3) engaging the surface to be treated and with means urging the frame structure against said surface.

3. Apparatus as claimed in claim 2, wherein the sections (2) constituting the screen structure includes a hollow space which can be filled with fluid by means of which the buoyancy of the sections (2) and a screen frame structure built up by assembled sections are controllable in order to adapt the draught of the screen frame structure as well as the upward thrust exerted thereby on the underside of the surface where the operations are to take place.

4. Apparatus as claimed in claim 2 or 3, wherein the screen frame structure built up by sections is provided with clamping means (4) permitting the screen frame structure to be clamped to the ship hull.

5. Apparatus as claimed in claim 2 or 3, wherein the sections are provided with joining units by means of which the sections are connectible with each other by interconnecting units (12) which allow angular variations.

6. Apparatus as claimed in claim 1, wherein the screen structure consists of a downwardly extending screen-wall (1') permanently secured to the edges of the surface on which operations are to be carried out.

7. Apparatus as claimed in claim 6, wherein the screen-wall is provided with a closable opening (7) in communication with a descending shaft (8).

8. A method of facilitating working on especially horizontal underwater portions of ship hulls, pontoons and other floating objects, comprising the steps of fitting, along the edges of the surface on which operations are to be carried out, a screen structure, sealing said screen structure tightly against the edges of said surface, said screen projecting downwardly from said surface, said screen structure having a bottom which is open for a major portion of the area circumscribed by said screen structure, filling said circumscribed area with water and introducing air with a pressure adapted to the water pressure prevailing at the actual depth into the volume associated with said circumscribed area and said screen structure in order to provide an air volume serving as a work-space, which is defined upwardly by the hull surface, laterally by the screen structure, and downwardly by the displaced water, and maintaining said pressure at a level so that said pressurized air is essentially the sole means for preventing contact between said water and said surface within said circumscribed area.

* * * * *